US007850481B2

(12) United States Patent
Amidon

(10) Patent No.: US 7,850,481 B2
(45) **Date of Patent: *Dec. 14, 2010**

(54) MODULAR JACK AND METHOD OF USE THEREOF

(75) Inventor: Jeremy Amidon, Marcellus, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/398,209

(22) Filed: Mar. 5, 2009

(65) Prior Publication Data

US 2010/0227497 A1 Sep. 9, 2010

(51) Int. Cl.
*H01R 11/20* (2006.01)

(52) U.S. Cl. ..... 439/417

(58) Field of Classification Search ..... 439/417, 439/404

See application file for complete search history.

(56) References Cited

U.S. PATENT DOCUMENTS

| | | | | |
|---|---|---|---|---|
| 4,202,593 | A | 5/1980 | Abernethy et al. | |
| 4,606,595 | A | 8/1986 | Dola | |
| 4,648,678 | A | 3/1987 | Archer | |
| 4,921,436 | A | 5/1990 | Sole et al. | |
| 5,118,310 | A * | 6/1992 | Stroede et al. | 439/676 |
| 5,228,872 | A | 7/1993 | Liu | |
| 5,338,221 | A | 8/1994 | Bowen et al. | |
| 5,403,200 | A | 4/1995 | Chen | |
| 5,501,617 | A | 3/1996 | Arnett | |
| 5,624,274 | A * | 4/1997 | Lin | 439/417 |
| 5,626,490 | A | 5/1997 | Pitts et al. | |
| 5,762,518 | A | 6/1998 | Tanigawa et al. | |
| 5,885,111 | A | 3/1999 | Yu | |
| 5,899,770 | A | 5/1999 | Ezawa | |
| 5,980,303 | A | 11/1999 | Lee et al. | |
| 6,010,353 | A | 1/2000 | Ensz et al. | |
| 6,105,229 | A | 8/2000 | Sullivan | |
| 6,109,943 | A | 8/2000 | Arnett | |
| 6,116,952 | A | 9/2000 | Nakata | |
| 6,250,951 | B1 | 6/2001 | Milner et al. | |

(Continued)

FOREIGN PATENT DOCUMENTS

| | | |
|---|---|---|
| JP | 2004319207 | 11/2004 |

(Continued)

OTHER PUBLICATIONS

U.S. Appl. No. 12/391,608; filed Feb. 24, 2009; Confirmation No. 7339; Customer No. 72687.

*Primary Examiner*—Truc T Nguyen
(74) *Attorney, Agent, or Firm*—Schmeiser, Olsen & Watts, LLP

(57) ABSTRACT

The present invention relates to modular jack and method of assembling thereof. The modular jack allows a portion of the stripped jacket of a cable to be contained within the housing of the jack. This ensures that the wires terminate with the insulation displacement contact very close to the point at which the wires are still twisted. A strain relief tab ensures that an external force on the cable does not interfere with the connection that the internal insulated wires make with the insulation displacement contacts of the conductive terminal, ensuring a reliable electrical connection. Termination is made by displacing the wire contact portion of the conductive terminal to pierce the insulation of the insulated wires.

24 Claims, 12 Drawing Sheets

U.S. PATENT DOCUMENTS

| | | | | |
|---|---|---|---|---|
| 6,338,643 | B1 | 1/2002 | Miller et al. | |
| 6,364,680 | B1 * | 4/2002 | Liu et al. | 439/329 |
| 6,402,561 | B1 | 6/2002 | Chen | |
| 6,416,349 | B1 | 7/2002 | Lee | |
| 6,435,898 | B2 | 8/2002 | Sahlberg et al. | |
| 6,561,838 | B1 | 5/2003 | Blichfeldt | |
| 6,749,456 | B1 | 6/2004 | Conner et al. | |
| 6,769,937 | B1 | 8/2004 | Roberts | |
| 6,780,063 | B2 | 8/2004 | Wang et al. | |
| 6,830,488 | B2 | 12/2004 | Bush et al. | |
| 6,890,210 | B2 | 5/2005 | Lee | |
| 6,932,641 | B1 | 8/2005 | Liao | |
| 7,052,307 | B2 | 5/2006 | Kim et al. | |
| 7,083,472 | B2 | 8/2006 | Gordon et al. | |
| 7,097,513 | B2 * | 8/2006 | Bryan | 439/676 |
| 7,118,405 | B2 | 10/2006 | Peng | |
| 7,249,961 | B1 * | 7/2007 | Provenzano | 439/409 |
| 7,540,640 | B2 | 6/2009 | Chen | |
| 2006/0246784 | A1 | 11/2006 | Aekins et al. | |
| 2010/0216331 | A1 | 8/2010 | Amidon | |

FOREIGN PATENT DOCUMENTS

| | | |
|---|---|---|
| JP | 2006228458 | 8/2006 |

* cited by examiner

MODULAR JACK AND METHOD OF USE THEREOF

BACKGROUND OF INVENTION

1. Technical Field

The present invention relates to a modular jack or electrical connector, and a method for assembling an electrical connector.

2. Related Art

Modular jacks are widely used in telecommunication systems for facilitating connection of electrical communication components. Ease of installation and consistent termination of internal insulated wires of a communications cable are two important features of a modular jack.

Ordinary jacks are designed to orient untwisted wires of a cable for termination with corresponding wire contact terminals according to common communication standards. Standard jack designs involve termination of the untwisted wires with contacts at a terminal location spaced away from where the wires are still bundled and twisted. Wire termination in ordinary jacks is often tedious because each wire must be individually aligned and positioned for termination. Moreover wire termination in common jacks can be faulty because the wires are not precisely located for termination with the jack during cable installation and because wires are often loosely oriented during installation instead of being firmly positioned into a proper termination location. In addition, movement of a cable, once installed, can cause strain that may dislodge the wires from proper termination with ordinary jack terminal contacts. Some known jacks also require use of special tools in order to consistently terminate the wires during installation of the cable to the jack. Accordingly a need exists for an improved modular jack and related method of use.

SUMMARY OF THE INVENTION

A first aspect of the present invention provides a modular jack comprising: a housing, having a socket and an internal chamber, wherein the socket is configured to receive a modular plug; at least one conductive terminal, having a wire contact portion and a plug contact portion, wherein the wire contact portion is located to extend within the internal chamber, wherein the plug contact portion is located within the socket and is configured to be electrically connected to the modular plug; a first conduit, configured to receive an external drive member into the internal chamber; a second conduit configured to receive a cable into the housing, wherein the cable comprises at least one insulated wire; at least one wire groove connected with the internal chamber within the housing, the at least one wire groove configured to receive a corresponding at least one insulated wire from the second conduit into the internal chamber; and wherein the wire contact portion extends into the internal chamber when driven by the external drive member, so that the wire contact portion terminates with a corresponding received insulated wire.

A second aspect of the present invention provides a modular jack comprising: a main body, configured to receive a modular plug, a cable, and an external drive member, wherein the cable comprises a plurality of insulated wires; at least one conductive terminal within the main body having an insulating displacement contact and a plug contact, wherein the plug contact is configured to be electrically connected to the modular plug; at least one wire groove within the housing, configured to receive a corresponding insulated wire of the cable; and wherein the insulation displacement contact is configured to move into contact with a received insulated wire and terminate the received insulated wire when a force is applied by the external drive member when it is received within body.

A third aspect of the present invention, a method of assembling a modular jack comprises: providing a housing, having a socket and an internal chamber; providing at least one conductive terminal, having a wire contact portion and a plug contact portion, wherein the wire contact portion is located within the internal chamber, wherein the plug contact portion is located within the socket and is configured to be electrically connected to a modular plug; providing a drive conduit and a cable conduit, wherein the cable conduit contains a plurality of groove extensions, the groove extensions in communication with the internal chamber; inserting a cable into the cable conduit, wherein the cable comprises a plurality of insulated wires, which wires are inserted into the internal chamber; inserting a drive member into the drive conduit until it makes contact with the wire contact portion of the conductive terminal; and applying a force by the inserted drive member to extend the wire contact portion into the internal chamber and terminate the wire contact portion with the insulated wire.

A fourth aspect of the present invention, a modular jack comprises: a housing, having a socket and an internal chamber, wherein the socket is configured to receive a modular plug; a cable, having a stripped jacket and a plurality of internal insulated wires; at least one conductive terminal, having a wire contact portion and a plug contact portion, wherein the wire contact portion is located to extend within the internal chamber, wherein the plug contact portion is located within the socket and is configured to be electrically connected to the modular plug; a conduit, configured to receive an external drive member into the internal chamber; at least one wire groove connected with the internal chamber within the housing, the at least one wire groove configured to receive a corresponding insulated wire of the cable, wherein the wire contact portion extends into the internal chamber when driven by the external drive member, so that the wire contact portion terminates with a corresponding received insulated wire; and means for securing the cable within the housing when the received insulated wire is terminated.

DETAILED DESCRIPTION OF THE INVENTION

Figure 1:
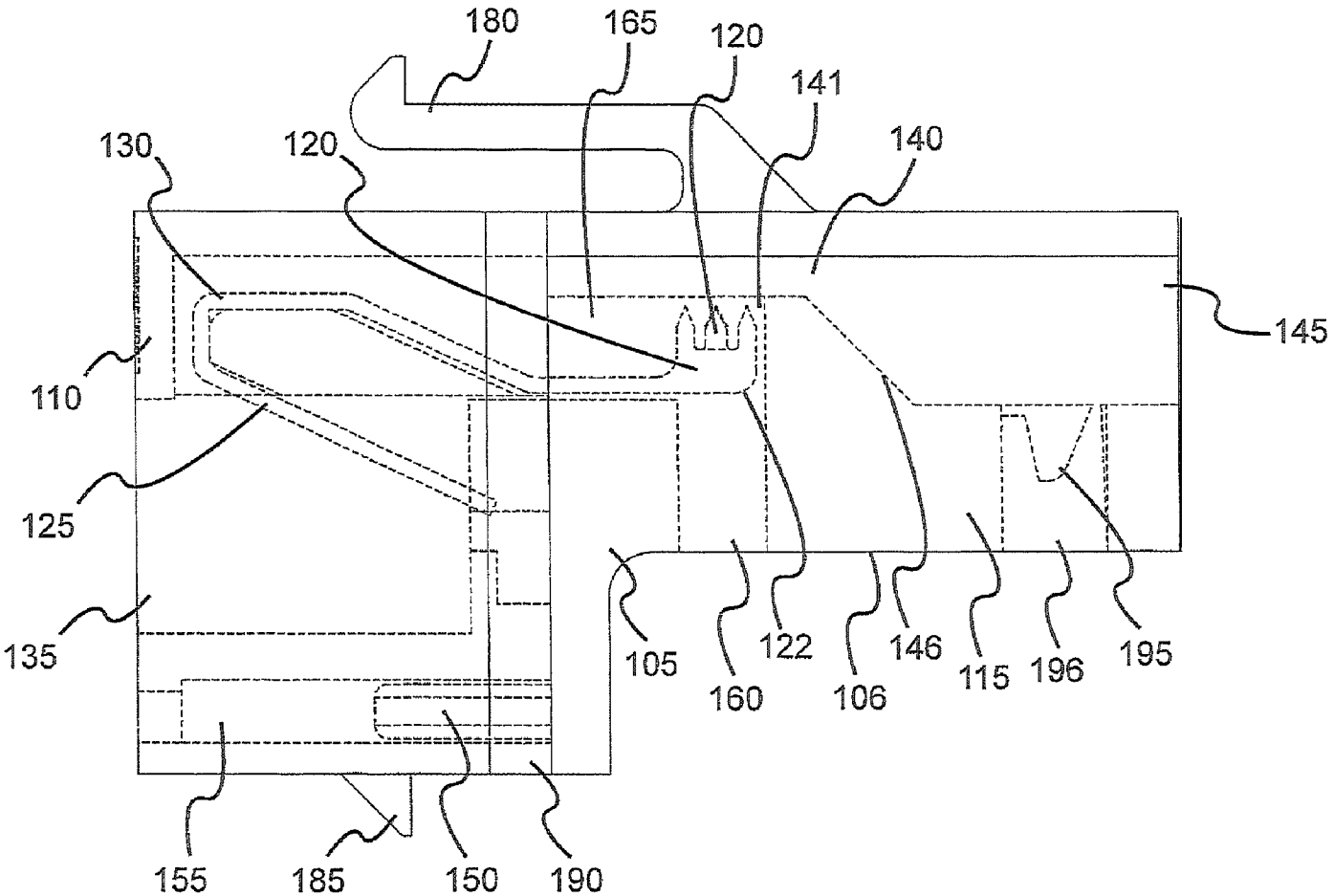
FIG. 1 shows a side view cutaway showing a modular electrical connector jack according to one embodiment of the present invention.
Figure 2:
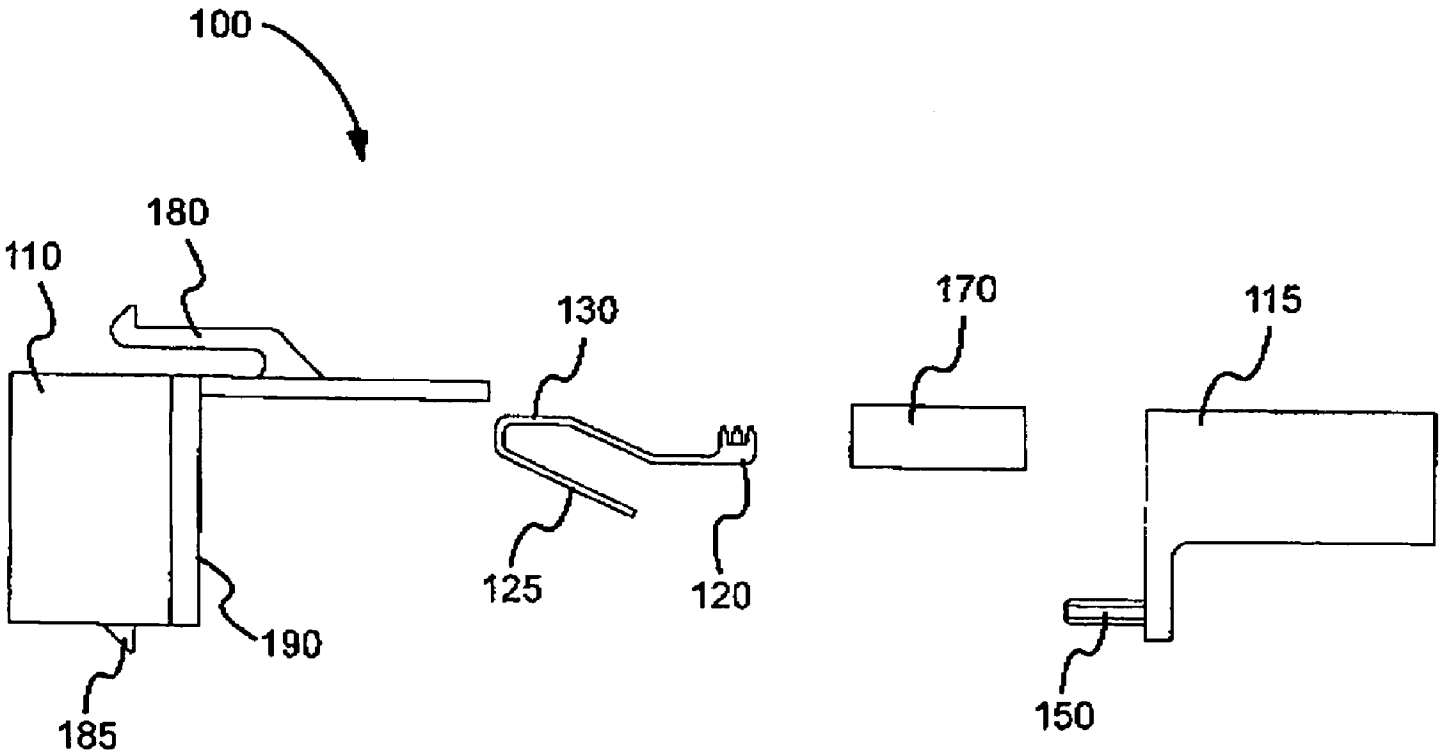
FIG. 2 shows a side view of a modular electrical connector jack prior to assembly according to one embodiment of the present invention.
Figure 3:
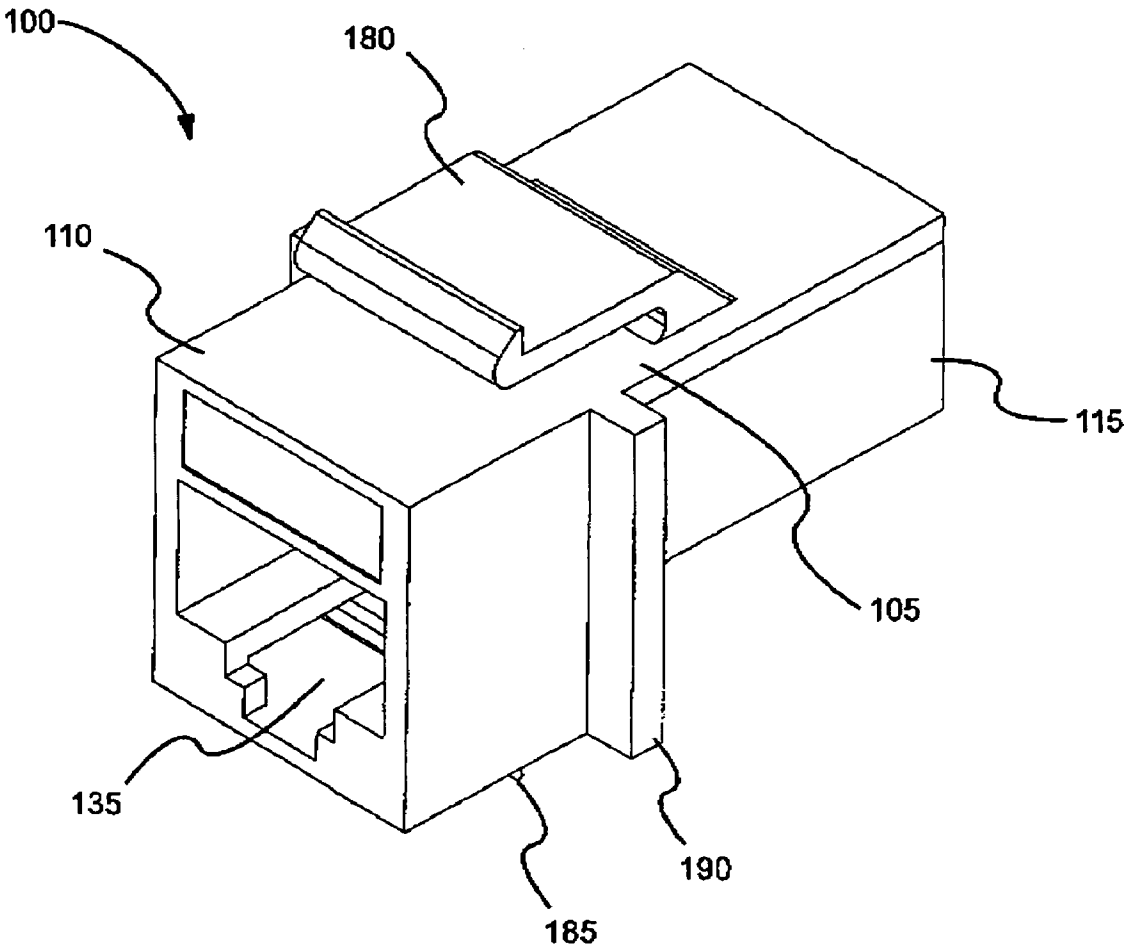
FIG. 3 shows a perspective view of a modular electrical connector jack according to one embodiment of the present invention.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a," "an" and "the" include plural referents, unless the context clearly dictates otherwise.

Referring to FIGS. 1-6 an electrical connector 100 is shown, having a housing portion 105. The electrical connector 100 may be a modular jack configured according to typical registered jack communication standards. Housing portion 105 may comprise at least two separate pieces, for example a first housing portion 110 and a second housing portion 115, attachably connected to form main body 105. A multi-piece housing is clearly shown in FIG. 2. Furthermore, one housing portion 110, 115 may include a mating connector 150 in order to aid in the assembly of the housing portion 105. Mating connector 150 may be designed to be inserted into the hollow 155 of a corresponding housing portion. Housing portion 105 may be a plastic material, or any other material that would help insulate electrical wiring from the outside environment, such as rubber or any other polymer.

Housing portion 105 may further comprise a resilient latch tab 180. Resilient latch tab 180 may cooperate with fixed latch member 185 to releasably retain the electrical connector 100 in assembly with an associated apertured wall plate (not shown). Resilient latch tab 180 may be located on the top face of main body 105, and fixed latch member 185 may be on the bottom face of main body 105. Alternately, resilient latch tab 180 and fixed latch member 185 may be located on any opposing faces. It should be understood by one of ordinary skill that latching combination 180, 185 is not limited to that as shown in FIGS. 1-5, but may also be a fastener, a catch, a clasp, a clench, a grip, a hold, a lock, a press, a snap and a vice so long as electrical connector 100 is releasably retained in assembly with the associated apertured wall plate.

Electrical connector 100 may include a socket 135. Socket 135 may be located on the front face of main body 105, and may be configured to accept a cable plug, including, but not limited to any type of registered jack (RJ) connector. For example, socket 110 may be configured to accept the plug connector of a shielded twisted pair (STP) cable, an unshielded twisted pair (UTP) cable, a screened shielded twisted pair (S/STP) cable, a fully shielded twisted pair (FTP) cable, or any variant thereof. Electrical connector 100 may therefore be any form of modular jack.

The electrical connector 100 includes at least one conductive terminal 130. Conductive terminal 130 may be housed within the housing portion 105. A further conductive terminal housing 170 may also be provided to further house and protect conductive terminal 130. Conductive terminal 130 may include a plug contact portion 125, and a wire contact portion 120. Plug contact portion 125 and wire contact portion 120 may be outside conductive terminal housing 170. Plug contact portion 125 may be a conductive finger, configured to be electrically connected to a modular plug (not shown). Plug contact 125 may therefore be located within socket 135.

Wire contact 120 may be an insulation displacement contact (IDC). Wire contact portion 120 may contain a prong, thorn, spike, or any other such point 121 as is commonly known in the art, having a sharpness sufficient to pierce or slice the insulation of a wire 60-67 extending from a cable 50, to create an electrical connection with the wire 60-67. The end of the cable 50 may be inserted into a second conduit 145. Further wire contact portion 120 may have a tool receiving surface 122 for contacting a termination tool (depicted in FIGS. 7-11). There may be a plurality of IDC's 120, each corresponding to at least one insulated wire 60-67 extending from cable 50. Embodiments of a modular electrical connector jack allow the contact between IDC(s) 120 and insulated wire(s) 60-67 to be very close to the point at which the insulated wires 60-67 are still twisted as commonly included in the single cable 50.

Electrical connector 100 may further comprise an internal chamber 165 within housing 105. Although not limited to this position, chamber 165 may be contained within a thinner portion of the housing 105 of jack 100. Wire contact portion 120 may be located within internal chamber 165. A first conduit 160 may facilitate extension of the wire contact portion 120 into the wire grooves 140 by driving the wire contact portion from outside of the housing 105. In this way, first conduit 160 may be configured to receive a drive object, such as a drive portion 506 of an external termination tool 500 (see FIGS. 7-11) into internal chamber 165. When the wire contact drive portion 506 of the termination tool 500 is inserted into drive conduit 160, it makes contact with termination tool receiving surface 122 of the wire contact portion 120. When a force is applied thereafter by the termination tool, the wire contact portion 120 may be displaced relative to the finger portion 125 of conductive terminal 130. The opening for drive conduit 160 may be located on the bottom face 106 of housing 105, and the termination tool 500 wire contact drive portion 506 may be inserted upwards into the housing 105. Alternately, the opening for drive conduit 160 may be located on any face of the housing 105 that will allow a corresponding termination tool 500 drive contact portion 506 to be inserted so that it contacts the tool receiving surface 122 of the wire contact portion 120 of the conductive terminal 130.

Embodiments of a modular electrical connector 100 may include a single drive conduit 160. For example, as embodied in FIGS. 7-11, the termination tool 500 may have an extending drive portion 506 that contacts each termination receiving surface 122 of a plurality of wire contact portions 120. Alternately, electrical connector 100 may include a plurality of drive conduits 160. In such an alternate embodiment, the corresponding termination tool 500 may have a corresponding plurality of narrow extending drive portions 506 which may be inserted into the corresponding plurality of drive conduits 160. A still further embodiment may include a cap or cover component having an extending drive portion configured to drive the wire contact IDC portion into a wire 60-67 when the cap or cover component is securely and compressively attached to the modular electrical connector jack 100, becoming an operable component of the modular jack 100.

Figure 6:
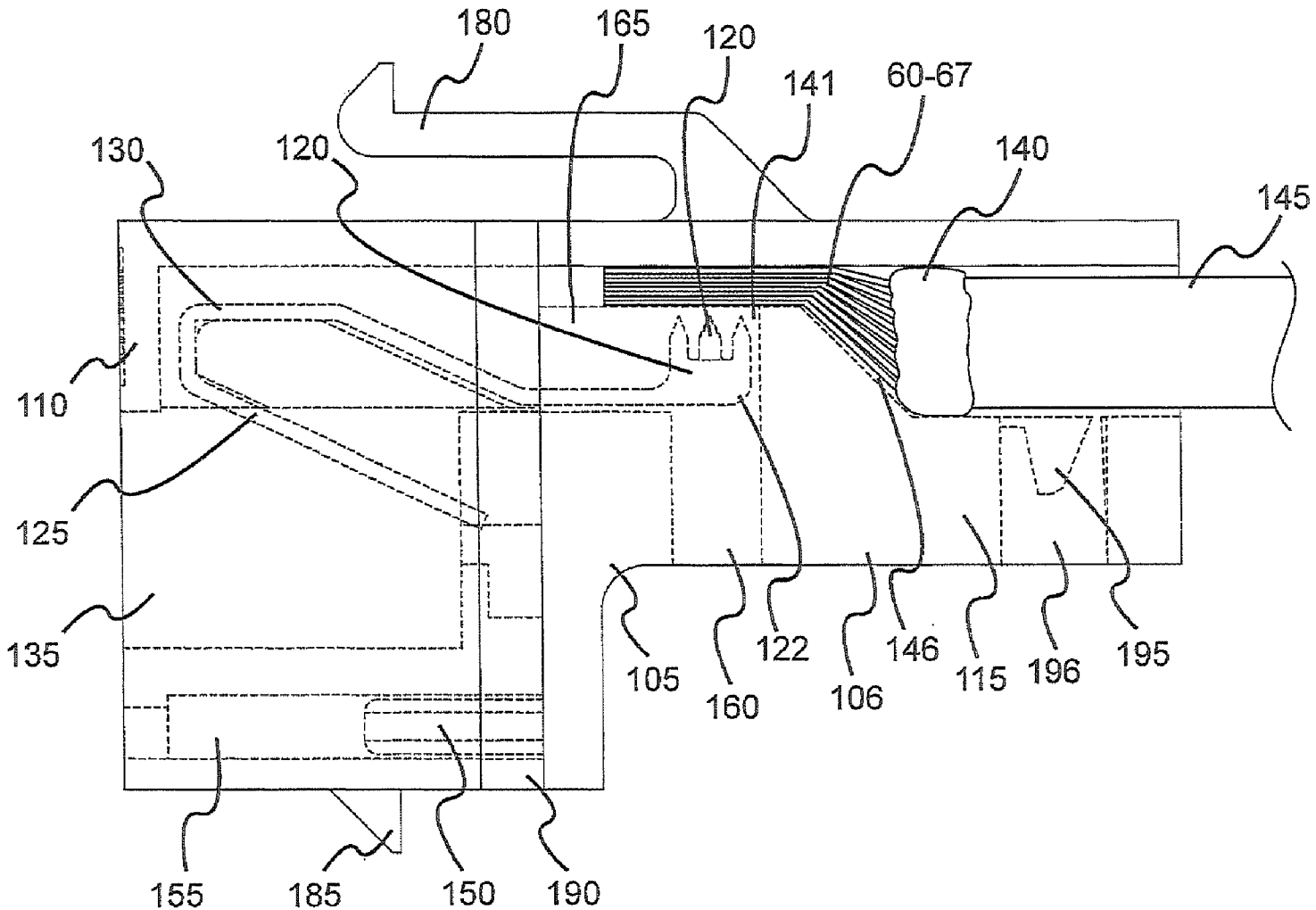
FIG. 6 shows a side view cutaway showing a modular electrical connector jack and received cable according to one embodiment of the present invention.
Figure 7:
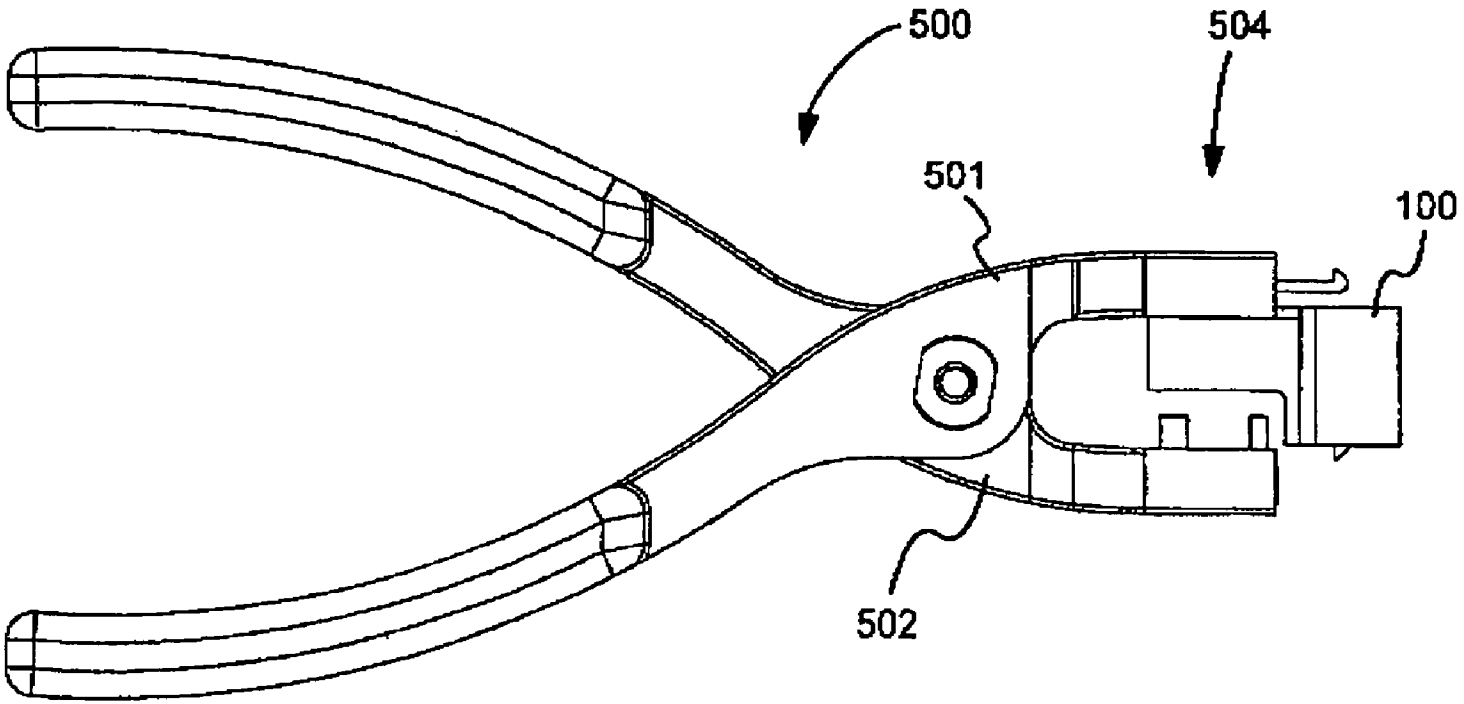
FIG. 7 shows a side view of a modular electrical connector jack as operably positioned with a termination tool according to one embodiment of the present invention.
Figure 8:
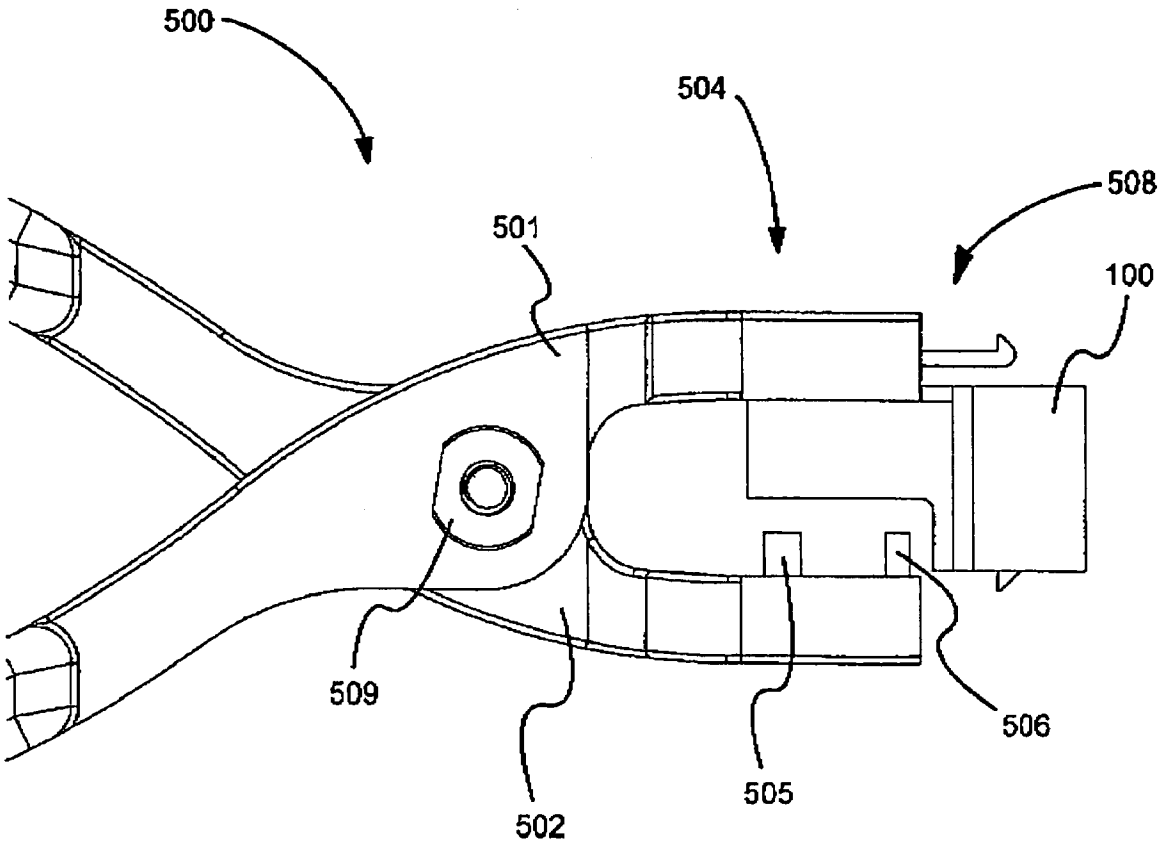
FIG. 8 shows a blown-up side view of a modular electrical connector jack as operably positioned with a termination tool according to one embodiment of the present invention.
Figure 9:
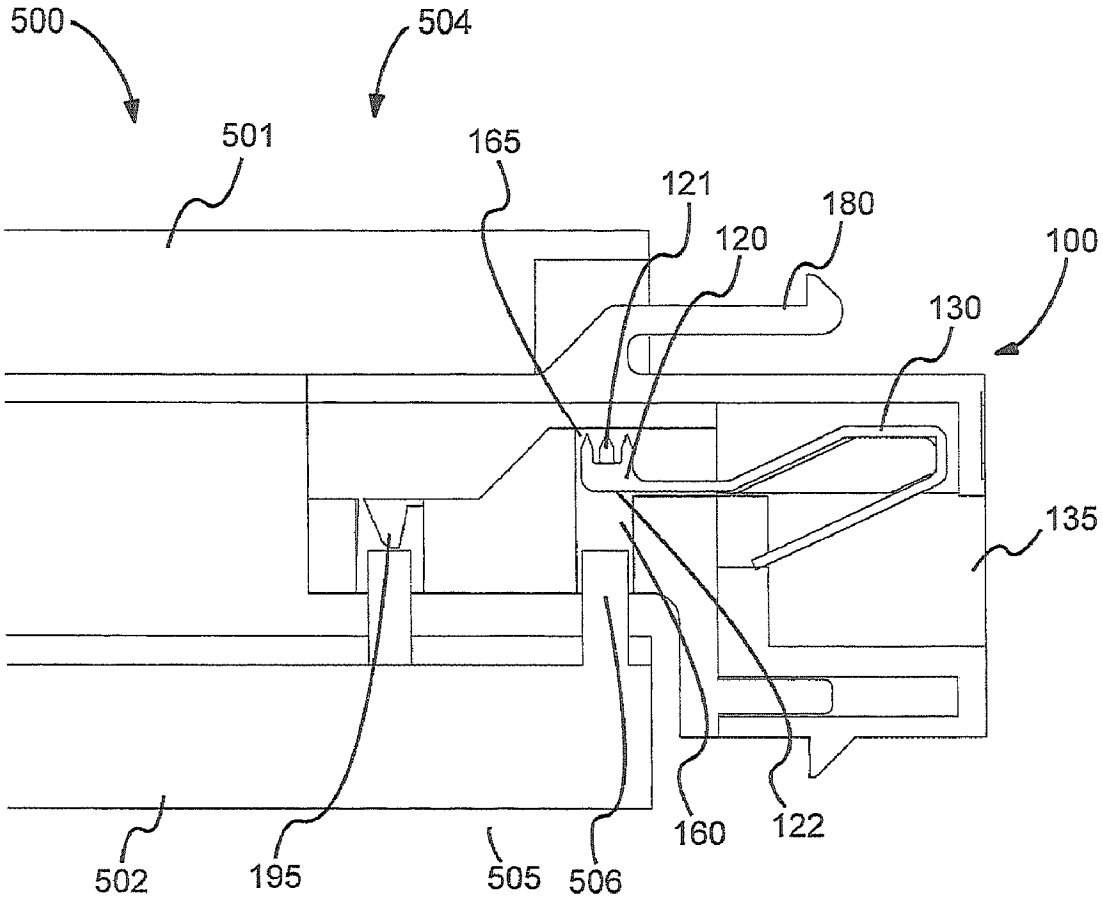
FIG. 9 shows a blown-up cut-away side view of a modular electrical connector jack as operably positioned with a termination tool just prior to compression of the wire contact portion by the drive member according to one embodiment of the present invention.
Figure 10:
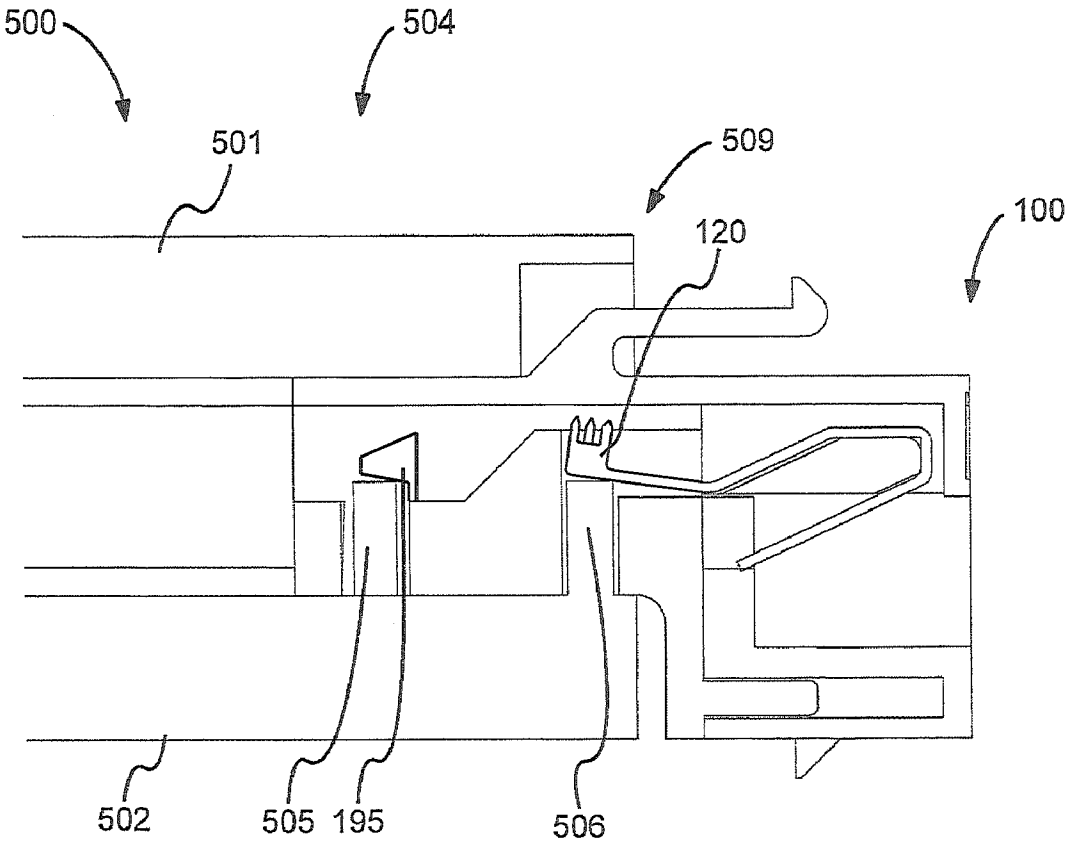
FIG. 10 shows a blown-up cut-away side view of a modular electrical connector jack as operably positioned with a termination tool following compression of the wire contact portion by the drive member according to one embodiment of the present invention.
Figure 11:
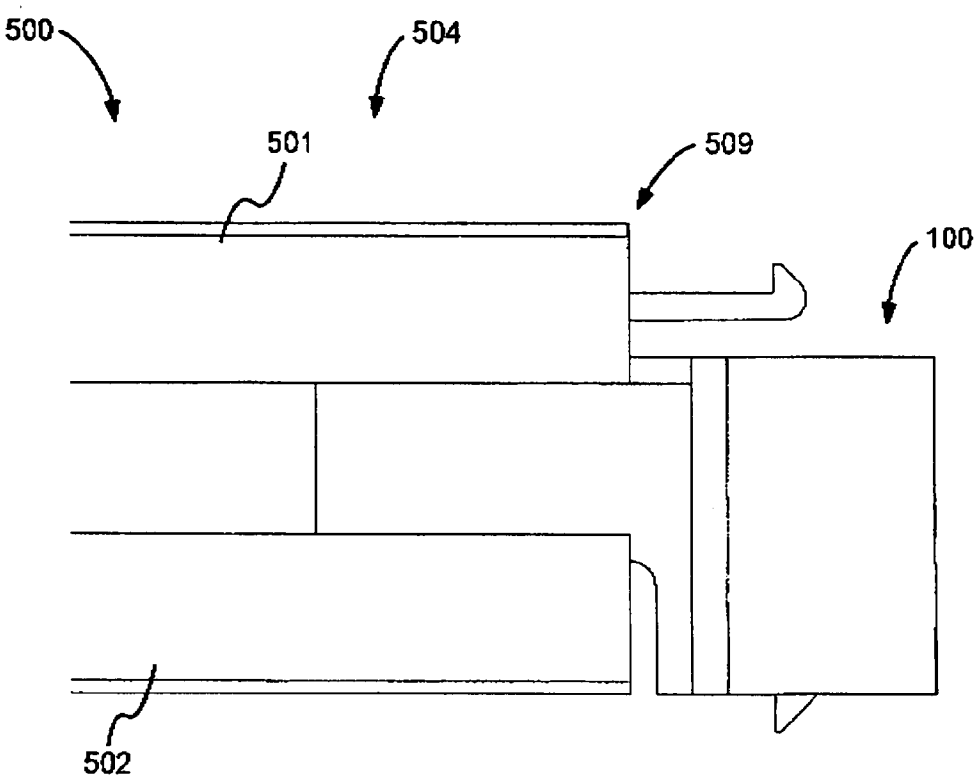
FIG. 11 shows a side view of a modular electrical connector jack as operably positioned with a termination tool following compression of the wire contact portion by the drive member according to one embodiment of the present invention.

Electrical connector 100 includes a second conduit 145 configured to receive a cable 50 into housing 105. The cable 50 may comprise at least one insulated wire 60-67, which may be the internal twisted wires of a STP, UTP, S/STP, or FTP cable, as described hereinabove. Cable 50 having internal insulated wires 60-67 is shown in FIG. 6 with its outer insulative layer 51 pealed back to reveal the twisted pairs of internal wires 60-67. The boundary or perimeter of conduit 145 may take any shape capable of receiving a cable 50, including circular, oval, square, rectangular, triangular, or any other shape commonly used in the art. Furthermore, the cross sectional area of conduit 145 may decrease as the distance in the conduit from the housing surface increases. In one embodiment, as shown in FIGS. 1 and 6, a ramp 146 reduces the cross sectional area of the conduit 145 by raising the level of the bottom of conduit 145. Other embodiments may include a non-linear ramp, a ramp lowering the level of the top of conduit 145, or any combination thereof.

Figure 4:
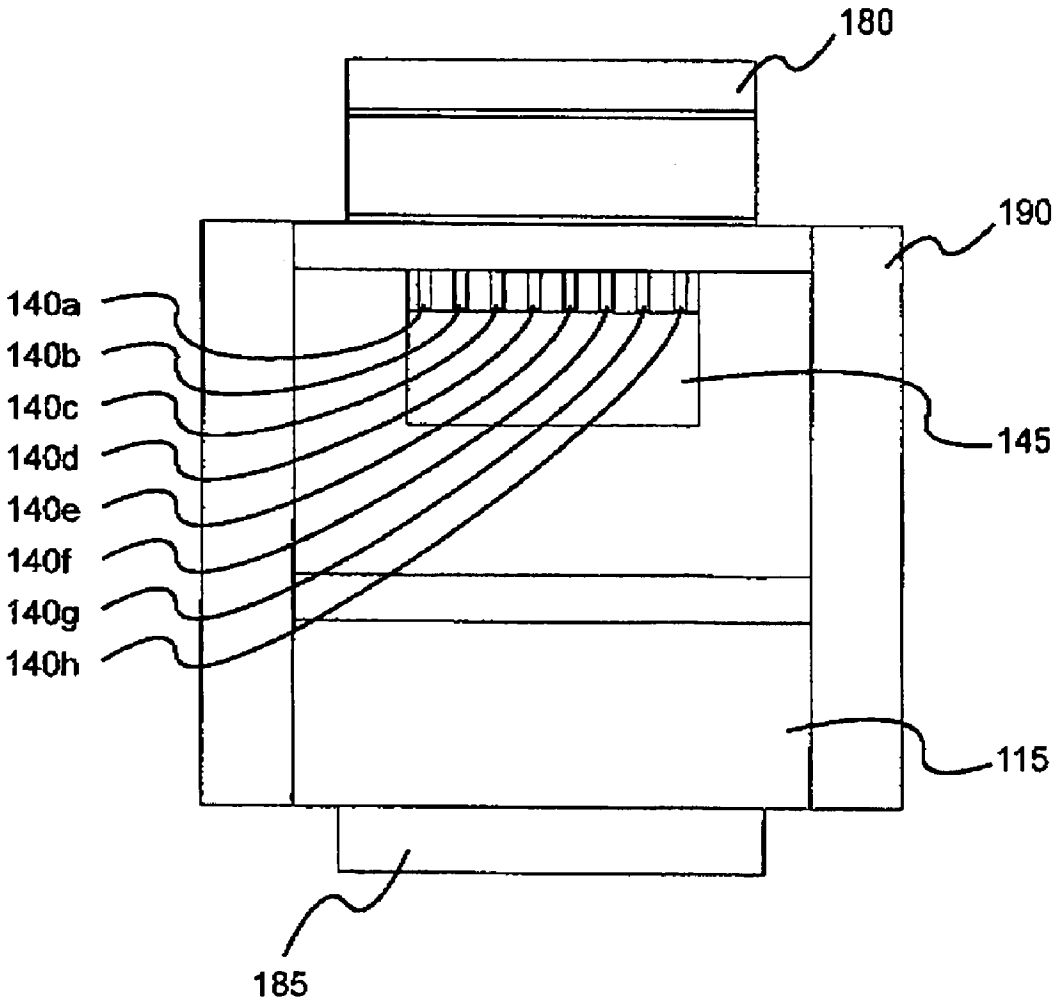
FIG. 4 shows a rear view of an assembled modular electrical connector jack according to one embodiment of the present invention.
Figure 5:
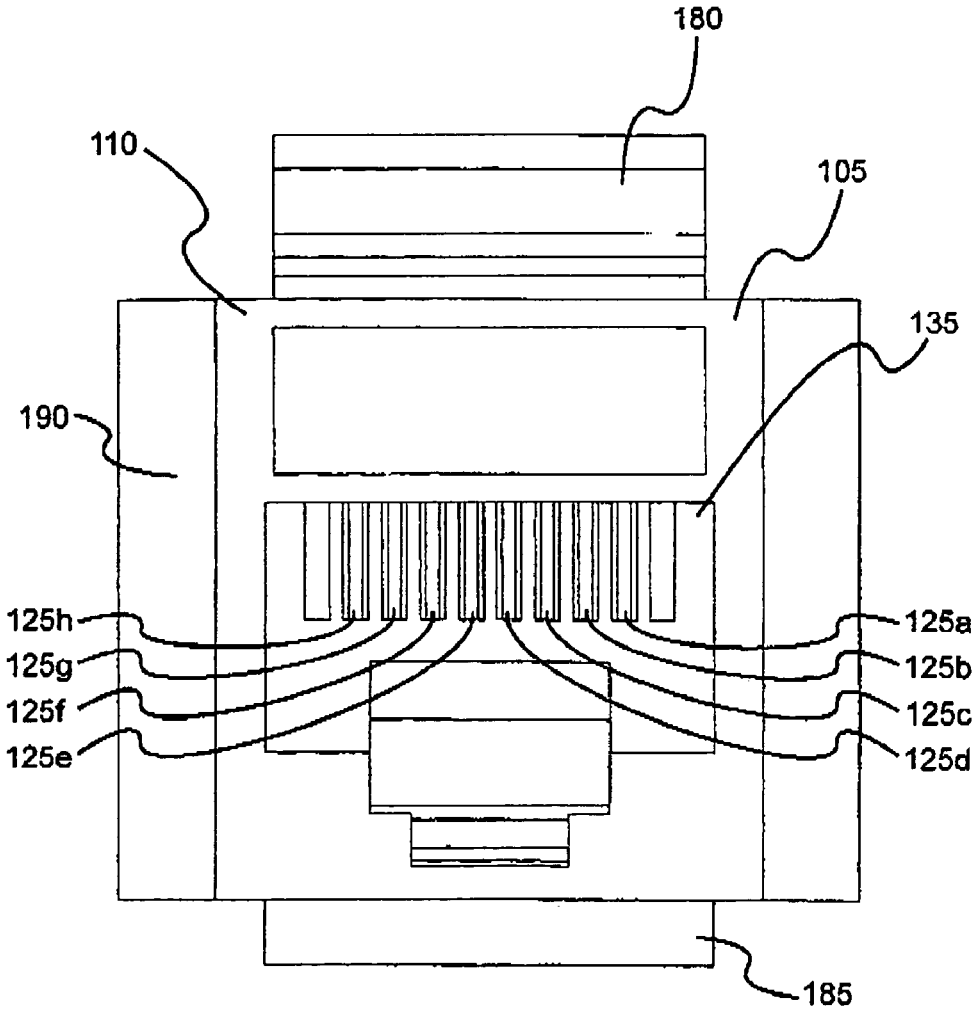
FIG. 5 shows a front view of an assembled modular electrical connector jack according to one embodiment of the present invention.

Extending from second conduit 145 may be at least one wire groove extension 140*a-h* (as depicted in FIG. 4). Wire grooves 140*a-h* may comprise a plurality of separate channels or conduits, each conduit 140*a-h* configured to accept a corresponding individual insulated wire 60-67 of cable 50. Alternately, wire grooves 140*a-h* may comprise a plurality of interconnected channels or conduits, also configured to accept a corresponding individual insulated wire 60-67 of a cable 50.

Modular electrical connector jack 100 may further comprise an opening 141 which may connect groove extension 140 with internal chamber 165. The contact points 121 of wire contact IDC 120 may be displaced from internal chamber 165 into groove extension 140 when a drive member, such as the drive portion 506 of termination tool 500, presses against drive member tool receiving surface 122 of wire contact IDC portion 120 of conductive terminal 130. When an insulated wire 60-67 has been inserted into the groove extension 140, the displaced points 121 of IDC 120 may pierce the insulation of wires 60-67, terminating the connection. Electrical connector 100 may contain a plurality of openings 141 which allow for a corresponding plurality of insulation displacement contacts 120 to be displaced into internal chamber 165 as previously described. Alternately, a single opening 141 may allow a plurality of insulation displacement contacts 120 to be displaced by the termination tool 500 drive portion 506 into the internal chamber 165.

Embodiments of a modular electrical connector jack 100 may further comprise a strain relief tab 195 located within a strain relief conduit extending from the bottom face 106 of the housing 105 of jack 100. The strain relief tab 195 may be provided for preventing the cable 50 from pulling out of cable conduit 145. Strain relief tab 195 may be positioned proximate the bottom face 106, toward the opening of conduit 145 into main body 105. As shown in FIGS. 7-11, a termination tool 500 may also be configured to include a strain tab drive portion 505, to push the strain relief tab 195 into cable conduit 145. The termination tool, may include a first movable member 501 and a second movable member 502, wherein the first and second movable members 501, 502 may be pivotable about a pin or bolt 509. The first and second movable members 501, 502, may be operated to pivotably compress a head portion 504 of the tool 500, thereby forcibly moving the wire contact drive member 506 and the tab drive member 505. When the strain relief tab 195 is driven into conduit 145, the outer insulation 51 of cable 50 is pinched and compressed, thus helping to prevent cable 50 from pulling out of conduit 145, which may occur due to external forces or tension that may be applied to the cable during use of the modular jack 100. Alternately, a strain relief tab 195 may be located on or proximate any face of housing 105, but preferably on the same face as the opening for drive conduit 160.

It will be apparent to those skilled in the art that the means for containing a portion of the jacket 51 of cable 50 within the housing 105 when the insulated wires 60-67 are terminated may take various forms. For example, as depicted in FIGS. 7-11, a strain relief tab 195 may be pushed into cable conduit 145 by a strain tab drive portion 505 of the termination tool 500. As embodied, the strain relief tab 195 may apply pressure to cable 50, holding it within cable conduit 145 when there are external pulling forces applied to cable 50.

Figure 12:
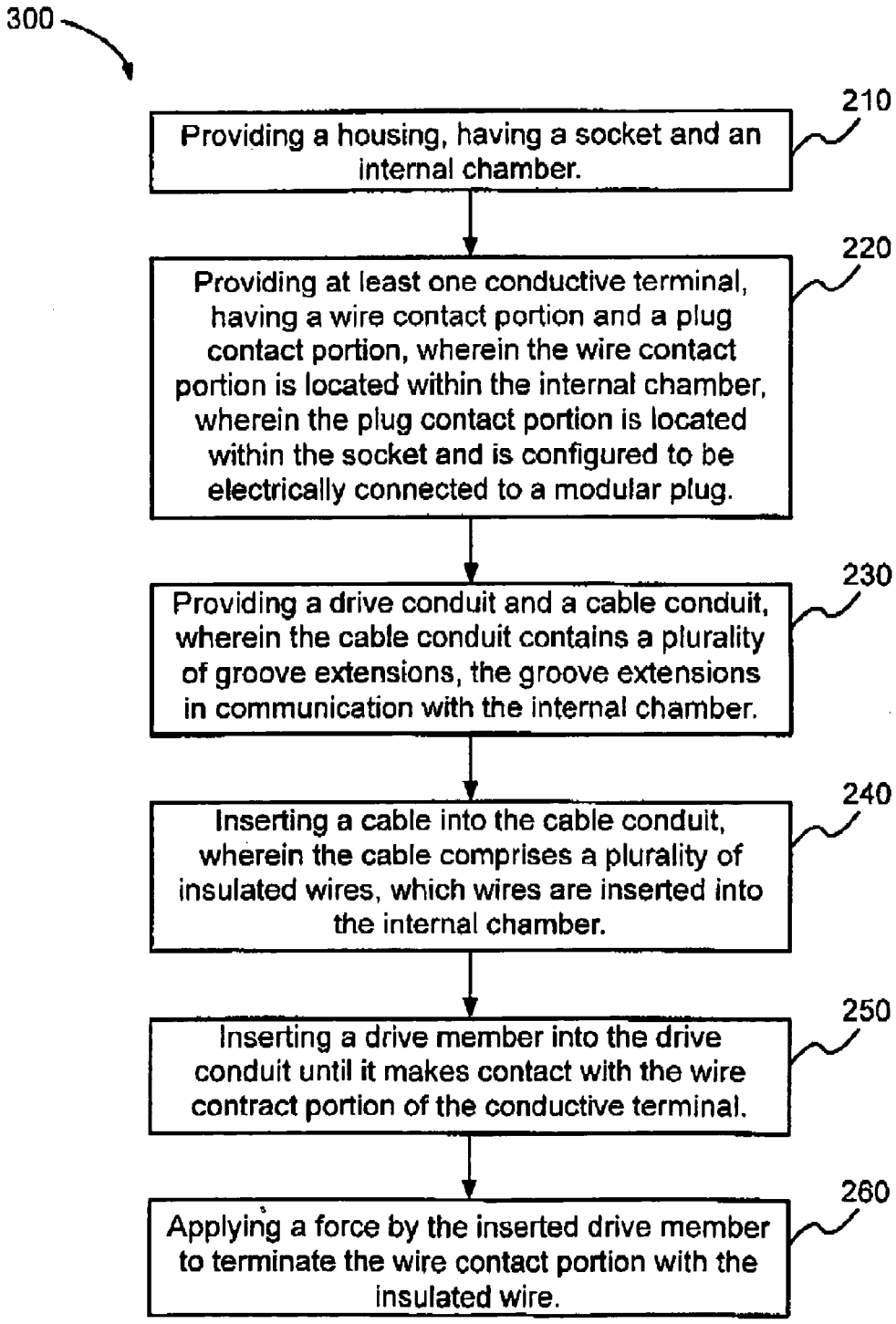
FIG. 12 shows a method for assembling an electrical connector according to one embodiment of the present invention.

Referring to FIG. 12, a method for assembling a modular jack 200 is shown. The assembly method 200 may comprise a step 210 of providing a housing having a socket and an internal chamber. The housing, socket and internal chamber have been described hereinabove as embodied by housing 105, socket 135 and internal chamber 165, as shown in FIGS. 1-11.

Method 200 may further comprise a step 220 of providing at least one conductive terminal, having a wire contact portion and a plug contact portion, wherein the wire contact portion is located within the internal chamber, wherein the plug contact portion is located within the socket and is configured to be electrically connected to a modular plug. Conductive terminal, wire contact portion and plug contact portion have been described hereinabove as conductive terminal 130, wire contact portion 120 and plug contact portion 125, as shown in FIGS. 1-11.

Method 200 additionally comprise a step 230 of providing a drive conduit and a cable conduit, wherein the cable conduit contains a plurality of groove extensions, the groove extensions in communication with the internal chamber. Drive conduit, cable conduit, and groove extensions have been described hereinabove as drive conduit 160, cable conduit 145, groove extensions 140*a-h*, as shown in FIGS. 1-11.

Method 200 may still further comprise a step 240 of inserting a cable into the cable conduit, wherein the cable comprises a plurality of insulated wires, which wires are inserted into the internal chamber. The cable comprising the plurality of insulated wires has been described as cable 50 having insulated wires 60-67 hereinabove, as shown in FIG. 6.

Moreover, method 200 may yet comprises a step 250 of inserting a drive member into the drive conduit until it makes contact with the wire contact portion of the conductive terminal. The wire contact portion may comprise an IDC 120 having a tool receiving surface 122 and the drive member may comprise a tool drive portion 506 of a tool 500, as shown in FIGS. 1-11.

Finally, method 200 may comprise a step 260 of applying a force by the inserted drive member to terminate the wire contact portion with the insulated wire. This force may displace the wire contact portion, such as wire contact IDC portion 120 relative to the finger portion 125 of contact terminal 130, and the displacement may occur through an opening 141 between the wire groove 140*a-h* and the internal chamber 165, as described hereinabove with reference to FIGS. 1-11.

Various modifications and variations of the described apparatus and methods of the invention will be apparent to those skilled in the art without departing from the scope and spirit of the invention. Although the invention has been described in connection with specific embodiments, outlined above, it should be understood that the invention should not be unduly limited to such specific embodiments. Various changes may be made without departing from the spirit and scope of the invention as defined in the following claims.

I claim:

1. A modular jack, comprising:

a housing, having a socket and an internal chamber, wherein the socket is configured to receive a modular plug;

at least one conductive terminal, having a wire contact portion and a plug contact portion, wherein the wire contact portion is located within the internal chamber prior to being terminated, wherein the plug contact portion is located within the socket and is configured to be electrically connected to the modular plug;

a first conduit, configured to receive an external drive member into the internal chamber;

a second conduit configured to receive a cable into the housing, wherein the cable comprises at least one insulated wire;

at least one wire groove connected with the internal chamber within the housing, the at least one wire groove configured to receive a corresponding at least one insulated wire from the second conduit into the internal chamber; and wherein the wire contact portion extends from the internal chamber into the at least one wire groove when driven by the external drive member, so that the wire contact portion terminates with a corresponding received insulated wire.

2. The modular jack of claim 1, wherein the housing further comprises a strain relief tab.

3. The modular jack of claim 1, wherein the housing is assembled from at least two pieces.

4. The modular jack of claim 3, wherein a first housing portion contains a male mating connector and a second housing portion contains a female mating connector, wherein the male and female mating connector attachably connect the first and second housing portions.

5. The modular jack of claim 1, further comprising a terminal support portion within the housing, wherein the terminal support portion holds the at least one conductive terminal in a proper position.

6. The modular jack of claim 1, wherein the wire contact portion has contact points having sharpness sufficient to pierce an insulation of the at least one insulated wire.

7. A modular jack, comprising:

a main body, configured to receive a modular plug, a cable, and an external drive member, wherein the cable comprises a plurality of insulated wires;

at least one conductive terminal within the main body having an insulating displacement contact and a plug contact, wherein the plug contact is configured to be electrically connected to the modular plug;

at least one wire groove within the housing, configured to receive a corresponding insulated wire of the cable;

wherein the insulation displacement contact is configured to move into contact with a received insulated wire and terminate the received insulated wire when a force is applied by the external drive member when it is received within body.

8. The modular jack of claim 7, wherein the main body further comprises a strain relief tab.

9. The modular jack of claim 7, wherein the main body is assembled from at least two pieces.

10. The modular jack of claim 9, wherein a first main body portion contains a male mating connector and a second main body portion contains a female mating connector, wherein the male and female mating connectors attachably connect the first and second housing portions.

11. The modular jack of claim 7, further comprising a terminal support portion within the housing, wherein the terminal support portion holds the at least one conductive terminal in a proper position.

12. The modular jack of claim 7, wherein the insulation displacement contact has contact points having a sharpness sufficient to pierce an insulation of the at least one insulated wire.

13. A method of assembling a modular jack, comprising:

providing a housing, having a socket and an internal chamber;

providing at least one conductive terminal, having a wire contact portion and a plug contact portion, wherein the wire contact portion is located to extend within the internal chamber, wherein the plug contact portion is located within the socket and is configured to be electrically connected to a modular plug;

providing a drive conduit and a cable conduit, wherein the cable conduit contains a plurality of groove extensions, the groove extensions in communication with the internal chamber;

inserting a cable into the cable conduit, wherein the cable comprises a plurality of insulated wires, which each of the individual wires are inserted into one of the plurality of groove extensions;

inserting a drive member into the drive conduit until it makes contact with the wire contact portion of the conductive terminal; and applying a force by the inserted drive member to extend the wire contact portion into the at least one wire groove and terminate the wire contact portion with the insulated wire.

14. The method of claim 13, wherein the housing further comprises a strain relief tab.

15. The method of claim 13, wherein the housing is assembled from at least two pieces.

16. The method of claim 15, wherein a first housing portion contains a male mating connector and a second housing portion contains a female mating connector, wherein the male and female mating connector attachably connect the first and second housing portions.

17. The method of claim 13, further comprising a terminal support portion within the housing, wherein the terminal support portion holds the at least one conductive terminal in a proper position.

18. The method of claim 13, wherein the wire contact portion has contact points having a sharpness sufficient to pierce an insulation of the at least one insulated wire.

19. A modular jack, comprising:

a housing, having a socket and an internal chamber, wherein the socket is configured to receive a modular plug;

a cable, having a stripped jacket and a plurality of internal insulated wires;

at least one conductive terminal, having a wire contact portion and a plug contact portion, wherein the wire contact portion is located within the internal chamber prior to being terminated, wherein the plug contact portion is located within the socket and is configured to be electrically connected to the modular plug;

a conduit, configured to receive an external drive member into the internal chamber;

at least one wire groove connected with the internal chamber within the housing, the at least one wire groove configured to receive a corresponding insulated wire of the cable, wherein the wire contact portion of the at least one conductive terminal extends into the at least one wire groove when driven by the external drive member, so that the wire contact portion terminates with a corresponding received insulated wire; and means for securing the cable within the housing when the received insulated wire is terminated.

20. A modular jack of claim 19, wherein the housing further comprises a strain relief tab.

21. A modular jack of claim 19, wherein the housing is assembled from at least two pieces.

22. A modular jack of claim 21, wherein a first housing portion contains a male mating connector and a second housing portion contains a female mating connector, wherein the male and female mating connectors attachably connect the first and second housing portions.

23. A modular jack of claim 19, further comprising a terminal support portion within the housing, wherein the terminal support portion holds the at least one conductive terminal in a proper position.

24. A modular jack of claim 19, wherein the wire contact portion has contact points having a sharpness sufficient to pierce an insulation of the at least one insulated wire.

* * * * *